United States Patent [19]

Heitmann et al.

[11] 3,962,906

[45] June 15, 1976

[54] METHOD AND APPARATUS FOR TESTING CIGARETTES OR THE LIKE

[75] Inventors: Uwe Heitmann; Heinz-Christen Lorenzen, both of Hamburg, Germany

[73] Assignee: Hauni-Werke Korber & Co., KG, Hamburg, Germany

[22] Filed: Mar. 28, 1974

[21] Appl. No.: 455,814

[30] Foreign Application Priority Data

Apr. 6, 1973 Germany ..... 2317295

[52] U.S. Cl. ..... 73/41; 73/38; 73/49.8

[51] Int. Cl.[2] ..... G01M 3/26; G01N 15/08

[58] Field of Search ..... 73/38, 41, 45, 45.1, 73/45.2, 45.3, 49.8

[56] References Cited

UNITED STATES PATENTS

| | | | |
|---|---|---|---|
| 2,676,485 | 4/1954 | Morgan | 73/38 |
| 3,386,281 | 6/1968 | Menge et al. | 73/38 X |
| 3,395,570 | 8/1968 | Kochalski | 73/38 X |
| 3,408,858 | 11/1968 | Kaeding et al. | 73/38 X |
| 3,485,084 | 12/1969 | Doerman | 73/45.1 |
| 3,677,068 | 7/1972 | Schmermund | 73/41 |
| 3,760,631 | 9/1973 | Doerman | 73/45.1 |
| 3,783,677 | 1/1974 | Heitmann | 73/41 |

*Primary Examiner*—Richard C. Queisser
*Assistant Examiner*—John S. Appleman
*Attorney, Agent, or Firm*—Peter K. Kontler; John Kurucz

[57] ABSTRACT

Cigarettes are tested with air streams which are caused to pass lengthwise through the fillers while the cigarettes move sideways past a testing station. One or two stationary chambers for air at subatmospheric or superatmospheric pressure are mounted at the testing station so that the ends of cigarettes which are being tested extend into the chamber or chambers. The air pressure in the chamber or chambers equals or approximates the pressure of air streams at the respective ends of the wrappers of cigarettes so that air in the chamber or chambers prevents the streams from communicating with the atmosphere during testing. The streams are monitored for changes in pressure. Such changes are indicative of defects of cigarettes and signals which are produced during monitoring are used to segregate defective cigarettes from satisfactory cigarettes.

16 Claims, 11 Drawing Figures

311
313
364
309
312
371
342
371
369
314
357
316
307
308
304
359
361
306
303

511
513
509
557
512
542
514
569
516
559
507
508
537
561
536
503

612
642
614
616
657
669
611
643
659
661
642
644
641

METHOD AND APPARATUS FOR TESTING CIGARETTES OR THE LIKE

BACKGROUND OF THE INVENTION

The present invention relates to a method and apparatus for testing rod-shaped articles which form part of or constitute smokers' products and wherein an open-ended tubular wrapper surrounds a gas-permeable filler which consists of tobacco and/or filter material. More particularly, the invention relates to improvements in a method and apparatus for testing rod-shaped articles, while the articles move sideways past a testing station, by resorting to streams of air or another suitable gaseous testing fluid which is caused to pass through the fillers of articles at the testing station whereby the pressure and/or another characteristic of the streams changes during passage through the fillers of articles with defective fillers and/or wrappers. Such changes in pressure and/or other characteristic or characteristics of the streams can be detected in a manner known per se and used for the generation of signals which effect segregation of defective articles from satisfactory articles.

The quality of plain or filter tipped cigarettes, filter rod sections and analogous rod-shaped articles depends to a large extent on the condition of their wrappers. An open seam and/or a hole in the wrapper warrents segregation of the respective article from other articles before the article with a defective wrapper reaches the storage and/or a packing machine. Therefore, the manufacturers of smokers' products invariably test the articles in order to detect and remove defective articles before they can reach the purchaser or the ultimate user. As a rule, cigarettes or analogous rod-shaped articles are tested with streams of air or another testing fluid which is introduced into one or both ends of a wrapper. If the pressure of the air stream changes to a predetermined extent, the wrapper of the article is likely to be defective and the respective article is automatically segregated from satisfactory articles.

During testing, the stream or streams of testing fluid which are introduced into the wrapper of an article to be tested must be sealed from the surrounding atmosphere because the communication of testing fluid with the surrounding air invariably results in inaccurate measurements and eventual segregation of satisfactory articles. Therefore, the testing fluid is normally introduced through suitable elements which engage the ends of the wrappers and the respective ends of fillers whereby the quality of sealing action depends on the extent to which the sealing elements are pressed against the adjacent ends of the wrappers and/or fillers. The force with which a sealing element is urged against the end of a wrapper cannot be increased at will because the sealing element would be likely to deform and/or deface the article. As a rule, even a very small foreign particle (such as a shred of tobacco or filter material) on that surface of a sealing element which engages the end of a wrapper and/or filler is likely to permit testing fluid to communicate with surrounding air and to distort the measurement of the pressure to such an extent that the respective article is discarded even though its filler and/or wrapper is satisfactory.

It was already proposed to seal the open ends of wrappers from the surrounding atmosphere by jets or currents of a sealing fluid which are directed against the external surfaces of the wrappers in the region of their ends. The currents are directed radially or substantially radially toward the external surfaces of the wrapper ends to form a barrier which prevents direct communication between the streams of testing fluid and the surrounding atmosphere. A drawback of such proposal is that the generation and maintenance of currents of sealing fluid consume substantial amounts of energy and can only be achieved by resorting to complex and bulky sealing devices which are prone to malfunction. Moreover, the generation of currents of sealing fluid takes up a certain amount of time so that such method of testing is not practical in a machine which turns out large quantities of rod-shaped articles per unit of time, e.g., in a machine for the production of plain or filter cigarettes wherein the cigarettes are produced at the rate of up to and in excess of 70 per second.

SUMMARY OF THE INVENTION

An object of the invention is to provide a novel and improved method of testing cigarettes, filter rod sections or analogous rod-shaped articles which form part of or constitute smokers' products, according to which the testing fluid is sealed or substantially sealed from the surrounding atmosphere in a novel and improved way.

Another object of the invention is to provide an effective and reliable method of testing cigarettes or like rod-shaped articles at the rate at which the articles issue from a modern high-speed producing machine.

A further object of the invention is to provide a method which can be resorted to for segregation of defective cigarettes from satisfactory cigarettes in such a way that the number of defective cigarettes which are not segregated from satisfactory cigarettes and/or the number of satisfactory cigarettes which are segregated with defective cigarettes is only a small fraction of the number of unsegregated defective cigarettes and/or segregated satisfactory cigarettes which are tested in accordance with heretofore known methods.

An additional object of the invention is to provide a novel and improved testing apparatus for cigarettes or the like and to provide the apparatus with novel and improved sealing means for reducing the extent of communication or for prevention any communication between testing fluid and the surrounding atomsphere.

Still another object of the invention is to provide the testing apparatus with novel and improved sealing elements which control the entry and/or escape of testing fluid from the wrappers of articles, and with novel and improved means for moving the sealing elements with and/or relative to the articles to be tested.

A further object of the invention is to provide an apparatus which can be used for the testing of cigarettes or the like with streams of testing fluid which are maintained at superatmospheric or subatmospheric pressure.

One feature of the invention resides in the provision of a method of testing filter rod sections, cigarettes, cigars, cigarillos or analogous rod-shaped articles wherein an openended tubular wrapper of cigarette paper, reconstituted tobacco, tobacco leaves or the like surrounds a gas-permeable filler of tobacco and/or filter material. The method comprises the steps of conveying the articles sideways past a testing station, passing streams of air or another gaseous testing fluid through the fillers of articles at the testing station whereby at least one characteristic (e.g., the pressure)

of the streams changes during passage through the fillers of articles having defective fillers and/or wrappers, monitoring the streams to detect changes in the one characteristic of the streams, and subject the exterior of at least one end of each wrapper at the testing station to the static pressure of air or another gaseous sealing fluid to thereby reduce the extent of or to prevent communication between the respective fluid stream and the atomsphere. Each fluid stream is preferably introduced into the respective filler at the one end of the corresponding wrapper, i.e., where te exterior of the wrapper end is subjected to the static pressure of sealing fluid.

The method may further comprise the step of at least partially sealing the fluid streams from the sealing fluid at the testing station, e.g., by resorting to deformable membranes which engage the ends of fillers and have one or more apertures for the passing of testing fluid.

The sealing fluid is preferably maintained at a (superatmospheric or subatmospheric) pressure which closely approximates or equals the pressure of testing fluid at the one end of a wrapper at the testing station.

The novel features which are considered as characteristic of the invention are set forth in particular in the appended claims. The improved testing apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
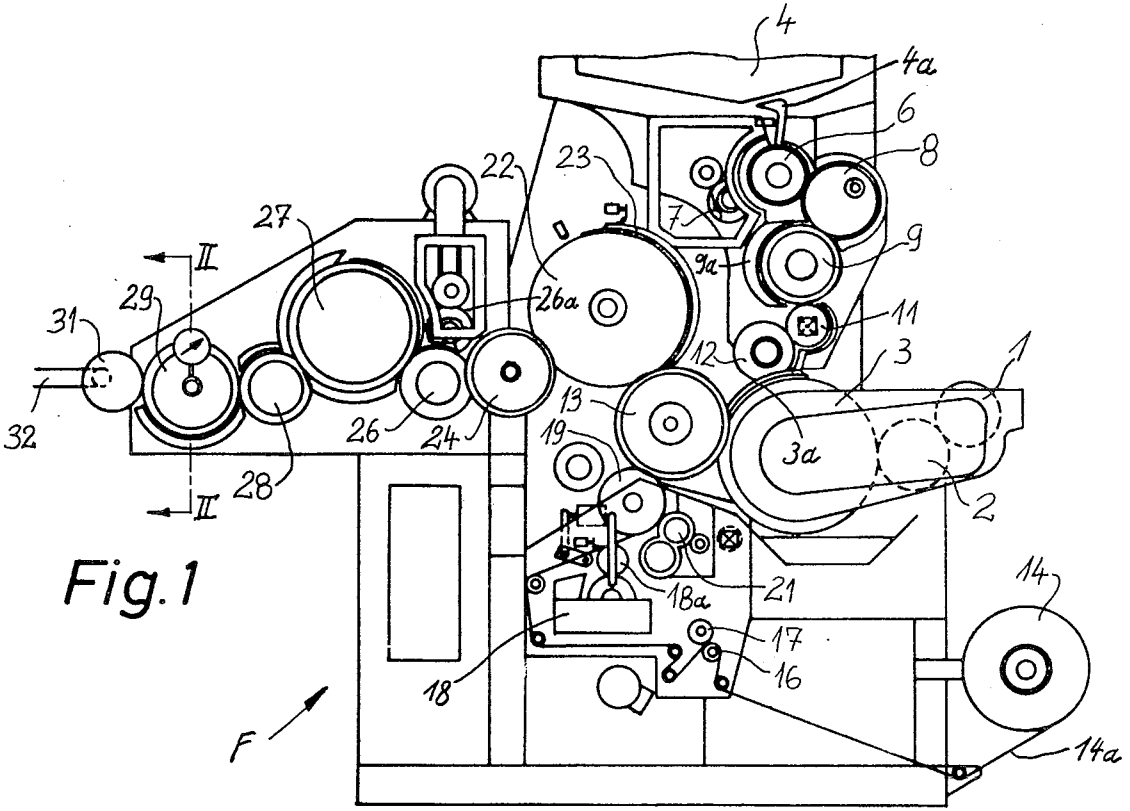
FIG. 1 is a schematic side elevational view of a filter cigarette making machine including a testing apparatus which embodies one form of the invention.

FIG. 1 shows a filter cigarette making machine of the type known as MAX, produced by Haui-Werke of Hamburg-Bergedorf, Western Germany. The machine of FIG. 1 is directly coupled with a machine (not shown) which makes plain cigarettes and includes a drum-shaped transfer conveyor 1 serving to transport two rows of plain cigarettes of unit length sideways so that each of the two rows is transferred onto one of two drum-shaped aligning conveyors 2 (only one shown) forming part of the filter cigarette making machine. The plain cigarettes of one row on the transfer conveyor 1 of the cigarette making machine are staggered with respect to the plain cigarettes of the other row. The purpose of the conveyors 2 is to align each plain cigarette of one row with a plain cigarette of the other row and to transfer pairs of aligned plain cigarettes into successive flutes of a drum-shaped assembly conveyor 3 in the filter cigarette making machine. The cigarettes in the flutes of the assembly conveyor 3 are spaced apart so that they provide room for insertion of filter plugs or filter rod sections of double unit length.

The machine of FIG. 1 further comprises a magazine or hopper 4 having a chute **4*a* which discharges a single row of filter rod sections of 6 times unit length so that each filter rod section enters a discrete flute of a drum-shaped severing conveyor 6 cooperating with two rotary knives 7 (only one shown) to subdivide each filter rod section of 6 times unit length into three coaxial filter rod sections or filter plugs of double unit length. The discrete filter plugs of successive groups of three coaxial filter plugs which are formed on the severing conveyor 6 are transferred onto three discrete staggering conveyors 8 which move the respective filter plugs along paths of different length and/or at different speeds so that each of the originally aligned or coaxial filter plugs of a group of three filter plugs leaving a flute of the severing conveyor 6 is staggered with respect to the other two plugs, as considered in the circumferential direction of the staggering conveyors 8. All three conveyors 8 deliver filter plugs into successive flutes of a drum-shaped shuffling conveyor 9 which cooperates with one or more stationary cams 9*a* to align the filter plugs whereby the filter plugs form a single row wherein each preceding plug is in exact register with the next-following plug. The shuffling conveyor 9 transfers successive filter plugs into successive flutes of a drum-shaped intermediate conveyor 11 which, in turn, transfers successive plugs into successive flutes of a drum-shaped accelerating conveyor 12 serving to insert a filter plug into the space between two coaxial plain cigarettes in each flute of the assembly conveyor 3. Thus, when a flute of the assembly conveyor 3 advances beyond the transfer station between the conveyor 3 and 12, it contains a group of three coaxial rod-shaped articles including two plain cigarettes of unit length and a filter plug of double unit length therebetween. Such groups then advance between two stationary cams 3*a* which move one or both plain cigarettes of each group axially toward the respective filter plug so as to eliminate the clearance between the filter plugs and the adjacent inner ends of aligned plain cigarettes before the groups are transferred onto a further drum-shaped conveyor 13.**

The frame F of the filter cigarette making machine supports a bobbin 14 of convoluted cigarette paper or cork web **14*a* which is being withdrawn by two advancing rolls 16 and 17. The leader of the web 14*a* adheres to the periphery of a rotary suction drum 19 which is adjacent to the conveyor 13. Before an increment of the web 14*a* reaches the suction drum 19, one side thereof is coated with adhesive which is stored in the tank of a conventional paster 18 and is being applied to the web 14*a* by a roller-shaped applicator 18*a*. The drum 10 cooperates with a rotary knife 21 which severs the leader of the web 14*a* at regular intervals so as to convert the web into a succession of adhesive-coated uniting bands each of which is attached to a group of articles on the conveyor 13** in such a way that a portion of the adhesive-coated side of a uniting band adheres to the filter plug as well as to the adjacent inner end portions of the aligned plain cigarettes of unit length.

The groups (each of which carries an adhesive-coated uniting band) are thereupon transferred onto a drum-shaped wrapping conveyor 22 which cooperates with a stationary or movable countersurface 23 to roll the uniting bands around the respective groups. Each uniting band is thereby converted into a tube surrounding the respective filter plug and the adjacent inner end portions of the aligned plain cigarettes of unit length. This completes the conversion of plain cigarettes and filter plugs into a row of filter cigarettes of double unit length. Such cigarettes are accepted by a further drum-shaped transfer conveyor 24 which delivers them into successive flutes of a drum-shaped severing conveyor 26 cooperating with a rotary knife 26*a* to sever each cigarette of double unit length midway across its filter plug so that each filter cigarette of double unit length yields two filter cigarettes of unit length. Each filter cigarette of unit length includes one of the plain cigarettes, one-half of the filter plug, and one-half of the respective tubular wrapper which is obtained by rolling a uniting band during passage through the gap between the conveyor 22 and the countersurface 23. The thus obtained pairs of filter cigarettes of unit length are thereupon transferred onto an inverting conveyor 27 which inverts one filter cigarette of each pair end-for-end so that the filter plugs of all filter cigarettes of unit length face in the same direction before they reach a further transfer conveyor 28. The inverted cigarettes of unit length are preferably placed into the spaces between neighboring non-inverted filter cigarettes of unit length. The conveyor 28 delivers successive filter cigarettes of unit length into successive flutes of a drum-shaped conveying member 40 (see FIG. 2) of a testing apparatus 29 which embodies the present invention. The apparatus 29 tests the fillers and/or wrappers of successive filter cigarettes of unit length and detects defective cigarettes which are thereupon segregated from satisfactory cigarettes. At least the satisfactory cigarettes are transferred onto a further conveyor 31 which delivers them onto the upper stretch of an endless conveyor belt 32 serving to transport satisfactory filter cigarettes to storage, to a tray filling apparatus or directly to a packing machine, not shown.

Figure 2:
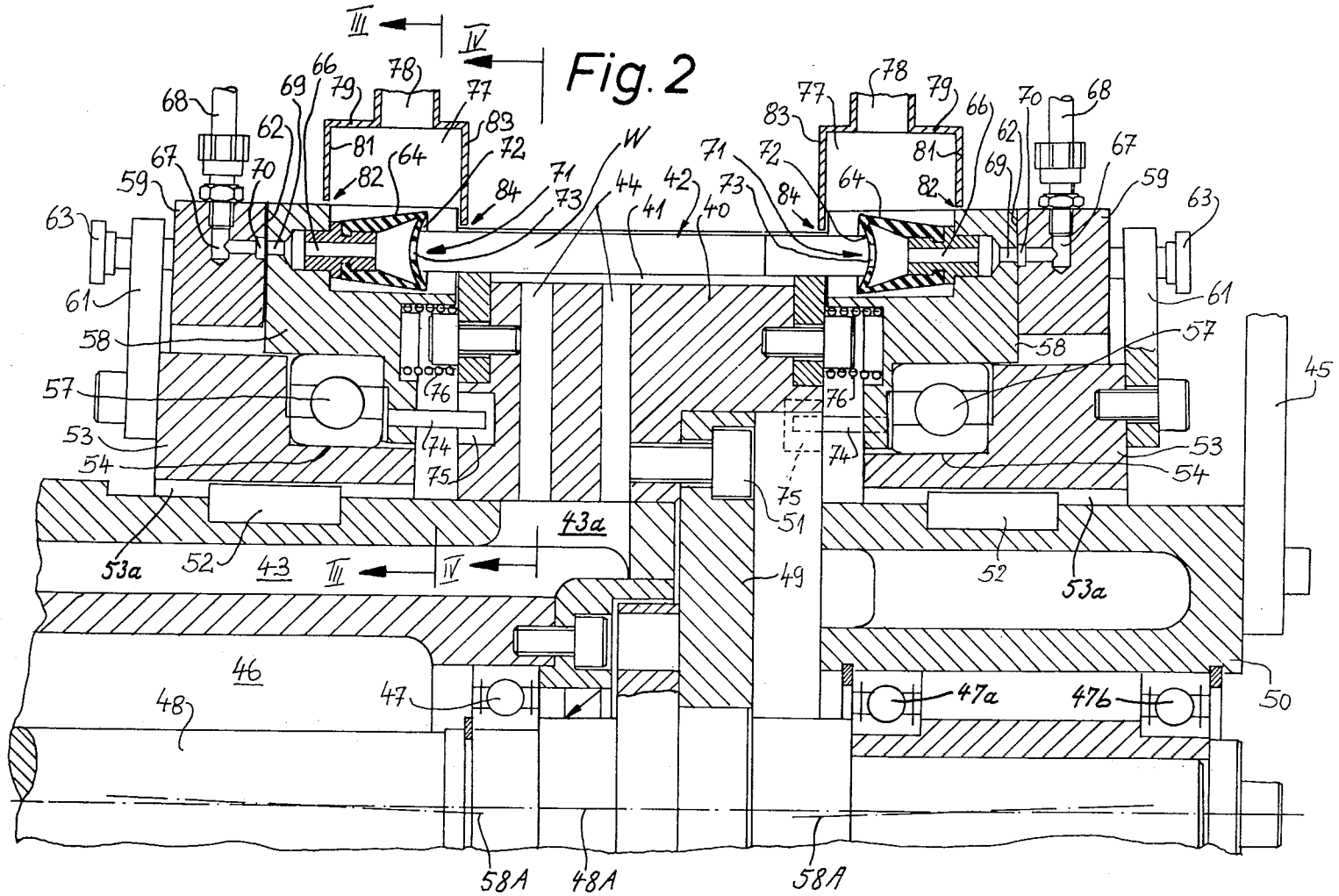
FIG. 2 is an enlarged fragmentary sectional view of the testing apparatus as seen in the direction of arrows from the line II—II of FIG. 1.
Figure 3:
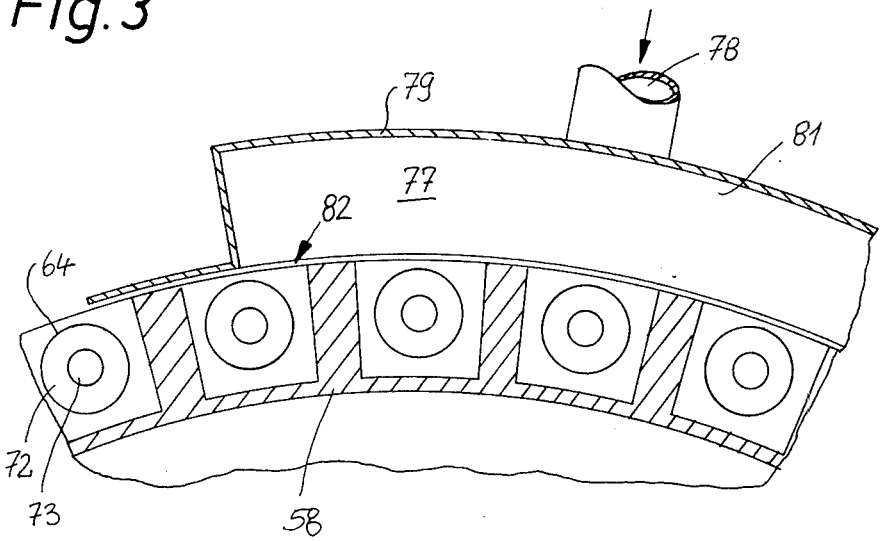
FIG. 3 is a fragmentary sectional view as seen in the direction of arrows from the line III—III of FIG. 2.
Figure 4:
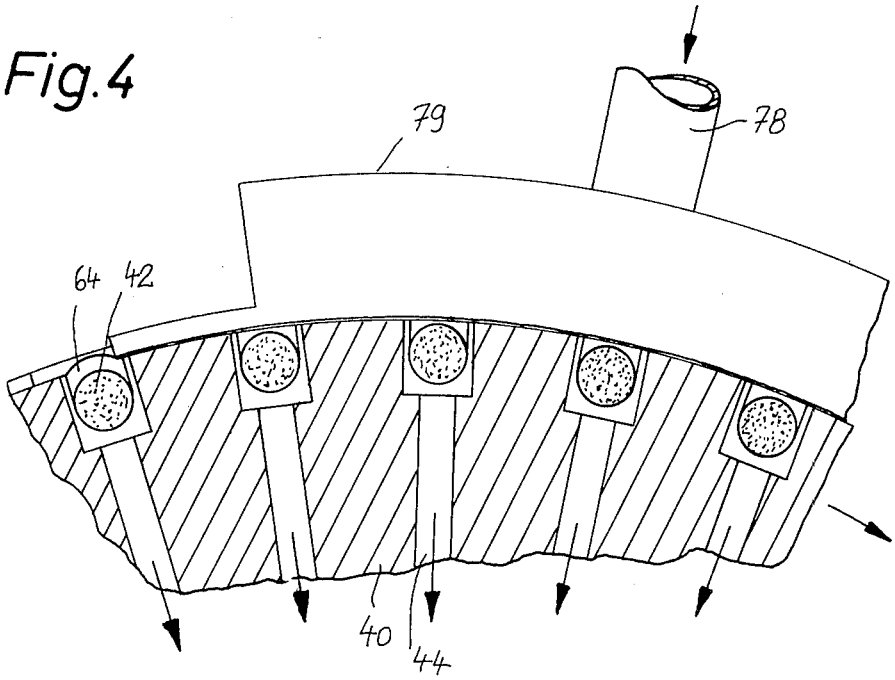
FIG. 4 is a fragmentary sectional view as seen in the direction of arrows from the line IV—IV of FIG. 2.

The details of the testing apparatus 29 are shown in FIGS. 2, 3 and 4. This apparatus is designed to test the condition of wrappers W of successive filter cigarettes 42 of unit length. Each such cigarette comprises a filler which consists in part of tobacco shreds and in part of fibrous or other filter material, and an open-ended tubular wrapper W which includes the wrapper of the respective plain cigarette, the wrapper of the respective half of a filter plug and one-half of the tube which is obtained in response to rolling of the corresponding adhesive-coated uniting band during travel between the conveyor 22 and countersurface 23 of FIG. 1.

The conveying member 40 of the testing apparatus 29 is a rotary drum having at its periphery a series of axially parallel receiving means or flutes 41 for discrete filter cigarettes 42. A filter cigarette 42 which is transferred into a flute 41 at the transfer station between the conveyor 28 of FIG. 1 and the drum 40 is attracted to the drum 40 by suction. To this end, the drum 40 is formed with pairs of radially inwardly extending suction ports 44 the outer ends of which communicate with the respective flutes 41 and the inner ends of which communicate with an arcuate slot 43*a* in the periphery of a stationary hollow shaft 46. The shaft 46 has an axially parallel channel 43 which is connected to a suction generating device, not shown, serving to draw air through those suction ports 44 which communicate with the arcuate slot 43*a*. The slot 43*a* extends from the transfer station between the conveyor 28 and the drum 40 to the transfer station between the drum 40 and the conveyor 31 of FIG. 1.

The means for rotating the drum 40 comprises a drive shaft 48 which is rotatable in antifriction bearings 47 installed in the interior of the hollow shaft 46 and is rigid with a ring-shaped torque transmitting element 49. The latter is coupled to the drum 40 by one or more screws or analogous fasteners 51. The hollow shaft 46 is located at one side of the element 49 and is coaxial with a stationary sleeve 50 which is located at the other side of the element 49. A portion of the drive shaft 48 extends into the sleeve 50 and is rotatable therein in antifriction bearings 47*a* and 47*b*. The sleeve 50 is secured to the frame F of the filter cigarette machine by one or more levers, links or analogous coupling devices 45. The hollow shaft 46 is surrounded by a ring-shaped bearing member 53 which has an internal axially parallel groove 53*a* for a key 52 of the shaft 46 so that the bearing member 53 is movable axially toward and away from the respective end of the drum 40. A similar second fixed ring-shaped bearing member 53 is mounted on the sleeve 50 and is movable axially toward and away from the adjacent end of the drum 40. The second bearing member 53 has a groove 53a for a key 52 of the sleeve 50. The two bearing members 53 are provided with inclined surfaces 54 for the inner races of two antifriction ball bearings 57 the outer races of which support two ring-shaped carriers 58. The axes of the carriers 58 are shown at 58A, and it will be noted that the axes 58A are inclined with respect to the axis 48A of the drive shaft 48. The bearing members 58 are mirror symmetrical to each other with respect to the central symmetry plane of the drum 40, i.e., with respect to a plane which is normal to the axis 48A and extends midway between the axial ends of the drum 40.

The testing station of the apparatus 29 is located at the upper end of the drum 40, as viewed in FIG. 2. During travel toward this testing station, successive increments of the carriers 58 approach each other and thereupon move away from each other after having advanced beyond the testing station. This is due to the aforedescribed inclination of the axes 58A with respect to the axis 48A. The distance between the carriers 58 at the testing station is determined by two segment-shaped cams 59 which are adjustably secured to the respective bearing members 53 by links 61 and screws 63. Further adjustments can be achieved by moving the bearing members 53 with respect to the shaft 46 and sleeve 50, i.e., along the respective keys 52. The cams 59 have inner end faces 62 which abut and sealingly engage the adjacent outer end faces of the respective carriers 58. Adjustments of the bearing members 53 along the respective keys 52 are necessary when the apparatus 29 is to be converted from testing of relatively short cigarettes 42 to the testing of longer cigarettes or vice versa. The manner in which the bearing members 53 can be respectively secured to the shaft 46 and sleeve 50 in selected axial positions is not shown in the drawing.

Each carrier 58 supports a set of tubular sealing elements 64, one for each flute 41 of the drum 40. Each sealing element 64 is mounted on a nozzle 66 which is embedded in the respective carrier 58 and has an axial passage for admission of testing fluid into the respective end 71 of the wrapper W in the aligned flute 41. The streams of testing fluid are admitted through nipples 68 which are secured to the cams 59 and discharge testing fluid into channels 67. Each channel 67 terminates in an elongated substantially bean-shaped groove 70 of the respective cam 59. The length of the grooves 70, as considered in the circumferential direction of the drum 40, determines the length of the testing station. The carriers 58 are provided with discrete connecting passages 69 which communicate with the adjacent grooves 70 during travel past the testing station and admit testing fluid into the axial passages of respective nozzles 66. The length of each groove 70 is preferably slightly less than the distance between the centers of two neighboring flutes 41 on the drum 40.

Each sealing element 64 preferably consists of a relatively soft elastically deformable material and comprises a membrane 72 which engages the adjacent end 71 of the respective wrapper W as well as the corresponding end face of the filler in such wrapper. Each membrane 72 is formed with a centrally located aperture 73 which admits a stream of testing fluid into the aligned filler. In the embodiment of FIGS. 2 to 4, the sealing elements 64 resemble frustoconical sleeves which consist of soft rubber or soft elastomeric synthetic plastic material. The membranes 72 are readily deformable to conform to the ends of the wrappers W and to the end faces of the respective fillers. Each aperture 73 can be replaced by several smaller apertures. The combined cross-sectional area of apertures in each membrane 72 should be large enough to permit the entry of a satisfactory stream of testing fluid. The aperture or apertures 73 are preferably provided in the central portions of the respective membranes 72 so as to insure that each thereof is overlapped by the adjacent end face of the corresponding filler.

The testing apparatus 29 further comprises a sealing means including two stationary plenum chambers 77 which are located at the testing station and each of which comprises a hollow casing 79 containing a stagnant supply of air or another suitable gaseous sealing fluid. The means for admitting sealing fluid to the internal compartments of the casings 79 comprises two discrete supply pipes 78 which receive sealing fluid from a blower or another source of compressed sealing fluid. As shown in FIGS. 3 and 4, the length of each casing 79, as considered in the circumferential direction of the drum 40, can exceed several times the distance between two neighboring flutes 41 of the drum 40. During travel past the testing station, the sealing elements 64 travel in the interior of the respective casings 79 so that the external surfaces of the ends 71 of wrappers W are subjected to the static pressure of sealing fluid which is confined in the respective chambers 77. Such sealing fluid prevents the streams of testing fluid from communicating with the surrounding atmosphere. The membranes 72 establish seals between the sealing fluid in the respective casings 79 and the streams of testing fluid which flow through the apertures 73 to enter the respective fillers.

Each casing 79 is secured to the frame F of the filter cigarette making machine of FIG. 1 and comprises an arcuate rear wall 81 which extends close to the periphery of the respective carrier 58 so as to define therewith a narrow gap 82 and to thus prevent the escape of substantial amounts of sealing fluid into the surrounding atmosphere. The front walls 83 of the casings 79 extend close to the periphery of the drum 40 and define therewith narrow arcuate gaps 84. The gaps 82 and 84 are sufficiently narrow to ensure that the amounts of sealing fluid which can escape into the atmosphere are negligible. The flutes 41 which travel past the testing station are caused to move along the concave internal surfaces of the front walls 83. In accordance with a presently preferred embodiment of the invention, the pressure of sealing fluid in the casings 79 equals or closely approximates the pressure of testing fluid which flows through the respective apertures 73 on its way into the aligned fillers of filter cigarettes 42. This further reduces the likelihood of escape of testing fluid into the casings 79 during travel of the respective sealing elements 64 past the testing station. Furthermore, such equalization of pressures of testing fluid and sealings fluid reduces the likelihood of penetration of sealing fluid through holes or other defects at the respective ends 71 of those wrappers W which travel past the testing station. Eventual mixing of sealing fluid with testing fluid and/or eventual mixing of testing fluid with surrounding atmospheric air would distort the measurements which are carried out by the testing apparatus in order to determine the condition of the wrappers W.

The means for coupling the carriers 58 to the drum 40, and hence with the torque transmitting element 49 of the drive shaft 48, comprises axially parallel pins 74 which extend into recesses or sockets 75 of the drum 40. The width of the sockets 75, as considered in the radial direction of the drum 40, exceeds the diameters of the coupling pins 74 to thus allow the carriers 58 to rotate about the respective axes 58A while sharing the angular movements of the drum 40. Helical springs 76 are interposed between the end faces of the drum 40 and the respective carriers 58 to bias the carriers against the end faces 62 of the adjacent cams 59. As explained above, the mounting of carriers 58 for rotation about axes (58A) which are inclined with respect to the axis 48A of the drive shaft 48 ensures that the pairs of registering sealing elements 64 which travel toward the testing station approach each other to thereby move the respective membranes 72 into engagement with the adjacent ends 71 of the wrappers W, and that the pairs of registering sealing elements 64 thereupon move away from each other so as to permit for removal of tested filter cigarettes 42 at the transfer station between the drum 40 and the conveyor 31 as well as for introduction of fresh filter cigarettes 42 at the transfer station between the conveyor 28 and drum 40.

The operation of the testing apparatus 29 is as follows:

The drive shaft 48 receives motion from the main prime mover of the filter cigarette making machine and causes the element 49 to rotate the drum 40 whereby the drum rotates the carriers 58 through the medium of the coupling pins 74. The channel 43 of the hollow shaft 46 is connected to the inlet of a fan or another suitable suction generating device which draws air from the slot 43a and from those suction ports 44 which communicate with the slot 43a during travel from the transfer station between the conveyor 28 and drum 40 toward the transfer station between the drum 40 and conveyor 31. Consequently, each filter cigarette 42 which enters a flute 41 at the transfer station between the conveyor 28 and drum 40 is attracted to the drum 40 by suction in the respective ports 44 and remains in the respective flute 41 until it reaches the transfer station between the drum 40 and conveyor 31. Two registering sealing elements 64 which reach the transfer station between the conveyor 28 and drum 40 allow for introduction of a cigarette 42 without any interference on the part of the respective membranes 72 due to the aforementioned mounting of carriers 58 for rotation about the axes 58A. As a filter cigarette 42 advances toward the testing station at the upper end of the drum 40 shown in FIG. 2, the corresponding sealing elements 64 are caused to move toward each other so that their membranes 72 engage the respective ends 71 of the wrapper W and the respective end faces of the filler in such wrapper. The inclination of the endless paths along which the sealing elements 64 travel toward, past and beyond the testing station is selected with a view to ensure a satisfactory sealing engagement between the wrappers W and fillers on the one hand and the respective membranes 72 on the other hand without, however, deforming and/or otherwise damaging the sensitive articles 42. Due to such sealing engagement between the membranes 72 and the respective ends of articles 42 which approach the testing station, the streams of testing fluid which are admitted by the nozzles 66 as soon as the nozzles reach the grooves 70 of the respective cams 59 enter the interior of the wrappers W practically without any losses in testing fluid. Consequently, by monitoring the pressure of testing fluid at the time such fluid is free to enter a wrapper W at the testing station, the apparatus 29 can determine whether or not the pressure and/or another characteristic of the respective stream is indicative of a satisfactory cigarette or of a defective cigarette. The defective cigarettes are thereupon segregated from satisfactory cigarettes, either during travel from the testing station toward the transfer station between the drum 40 and conveyor 31, on the conveyor 31, or on the conveyor belt 32. As a rule, the monitoring of streams of testing fluid is performed by a suitable transducer which produces electric or other signals, and such signals are utilized to bring about segregation of defective cigarettes from satisfactory cigarettes.

During travel past the testing station, the external surface of each end 71 of a wrapper W is subjected to the static pressure of sealing fluid in the respective casing 79. This ensures that sealing fluid cannot escape between the end faces of the fillers and the adjacent membranes 72 while the corresponding sealing elements 64 travel in the interior of the respective chambers 77. In the absence of chambers 77, a single tobacco shred between the outer side of a membrane 72 and the adjacent end 71 of a wrapper W would permit testing fluid to escape at a rate which would be detected by the transducer and would cause segregation of the respective cigarette 42 in spite of the fact that the wrapper of such cigarette is satisfactory.

It will be noted that the width of those portions of the external surfaces of the wrappers W which travel past the testing station and are subjected to the static pressure of sealing fluid in the respective casings 79 can equal or even exceed the radius of a cigarette 42. Such mode of testing is desirable because defects at the ends 71 of wrappers W need not be detected by the apparatus 29. This will be readily appreciated by considering that a small hole at the tobacco-containing end of a filter cigarette 42 is not likely to adversely influence the flow of smoke into the smoker's mouth since such defect is eliminated as soon as the cigarette is lighted because the lighting results in practically immediate burning of the outer end of the wrapper. For the same reason, the defects of the wrapper at that end which is placed into the mouth also cannot unduly affect the pleasure of the smoker since a certain length of the plug is usually placed into the mouth so that the escape of tobacco smoke through a hole at the very end of the filter plug does not influence the flow of smoke into the mouth.

As a freshly tested cigarette 42 advances beyond the testing station, the corresponding sealing elements 64 are moved apart so that the membranes 72 are disengaged from the respective ends 71 of the wrappers W in order to permit the transfer of tested cigarettes into the flutes of the conveyor 31. The sealing elements 64 remain spaced apart during travel toward and past the transfer station between the conveyor 28 and drum 40 so that the conveyor 28 can insert a fresh filter cigarette 42 without any interference on the part of the membranes 72. As mentioned before, the slot 43a in the stationary shaft 46 extends between the two transfer stations so that suction in the ports 44 approaching the conveyor 31 is terminated in order to allow for convenient removal of a tested filter cigarette 42 from the respective flute 41. The ports 44 begin to communicate with the slot 43a as they approach or reach the transfer station between the conveyor 28 and drum 40 so that suction in these ports can attract a fresh cigarette 42 from the adjacent flute of the conveyor 28. The manner in which defective cigarettes are segregated from satisfactory cigarettes forms no part of the present invention. As a rule, the aforementioned signals are utilized to actuate a pneumatic ejecting or segregating device having a nozzle which is adjacent to the path of cigarettes 42 and is connected to a source of compressed air at the very moment when it is in register with a defective cigarette whereby the air stream expels the defective cigarette from the path and causes it to descend or otherwise advance into a collecting receptacle, not shown.

It is equally within the scope of the invention to test cigarettes 42 by streams of testing fluid which is maintained at less than atmospheric pressure. The nipples 68 are then connected to a suitable suction generating device which draws air from the connecting passages 69 at the testing station and hence from the wrappers W which travel past the testing station. The aforementioned transducer is then designed to detect eventual rise in the pressure of testing fluid to thus indicate the presence of a defective cigarette. This will be readily appreciated by considering that, if the wrapper W shown in FIG. 2 has a hole or an open seam, air will be permitted to flow into the respective filler while the sealing elements 64 draw air from the filler at the respective ends 71. The pressure of testing fluid which flows into the nipples 68 then increases and the transducer detects such increase in the pressure of testing fluid to initiate the ejection or segregation of the corresponding cigarette 42.

It is further within the purview of the invention to utilize in the testing apparatus 29 an annulus of apertured membranes 72 and an annulus of membranes which are not provided with apertures 73. The non-apertured membranes then seal one end of each cigarette which reaches the testing station while the other membranes permit a testing fluid to flow into or from the respective wrappers W whereby the transducer monitors the inflowing or outflowing streams of testing fluid and produces signals which are used for segregation of defective cigarettes.

Figure 5:
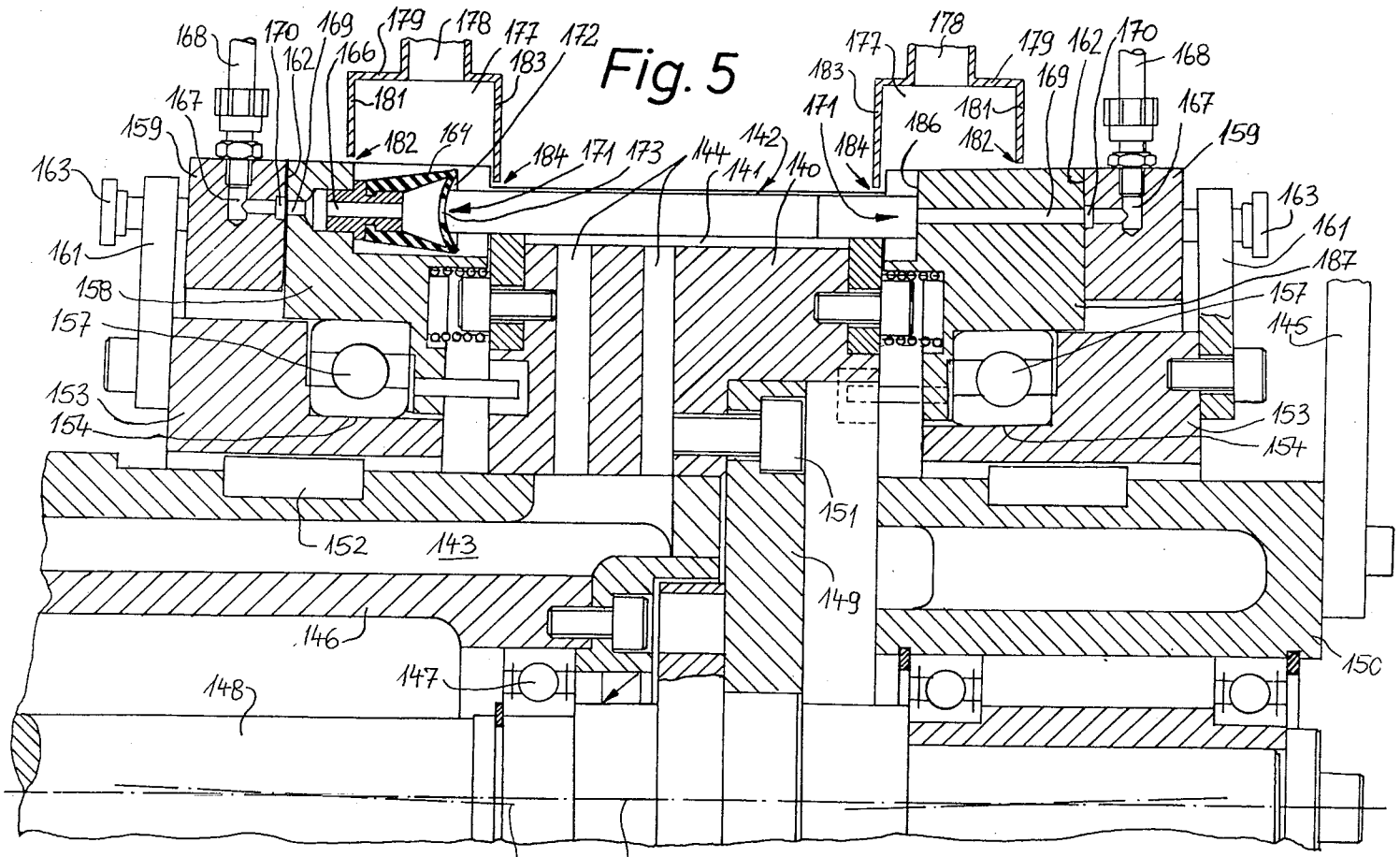
FIG. 5 is a sectional view similar to that of FIG. 2 but showing a portion of a second testing apparatus.

FIG. 5 shows a portion of a second testing apparatus wherein all such parts which are identical with or clearly analogous to the corresponding parts of the apparatus shown in FIGS. 2 to 4 are denoted by similar reference characters plus 100. The apparatus of FIG. 5 utilizes a single annulus of equidistant sealing elements 164 which serve to admit streams of testing fluid into the wrappers of filter cigarettes 142 advancing past the testing station (see the groove 170 of the left-hand cam 159 and the aligned groove 170 of the right-hand cam 159). During travel past the testing station, the right-hand ends 171 of the wrappers of cigarettes 142 abut against the sealing surface 186 of the right-hand carrier 187 which is not provided with any sealing elements. The carrier 187 actually constitutes a sealing ring which is formed with axially parallel passages 169 each of which registers with a connecting passage 169 in the left-hand carrier 158. The passages 169 of the carrier 187 communicate with the right-hand groove 170 during travel past the testing station and allow testing fluid to flow into the right-hand channel 167 and right-hand nipple 168 which conveys such testing fluid to the transducer. The transducer determines the pressure of testing fluid and produces signals when the pressure deviates from a satisfactory pressure range so that the signal can be utilized to segregate the respective cigarette 142 from satisfactory cigarettes.

The carrier 187 of FIG. 5 can be replaced by a sealing ring which does not have any passages 169. The surface 186 of the sealing ring then completely seals the right-hand ends 171 of the wrappers of cigarettes 142 which advance past the testing station. The sealing elements 164 then draw testing fluid from or admit testing fluid into the fillers of cigarettes 142 at the testing station whereby the transducer determines the changes in characteristics of fluid streams which flow through the left-hand nipple 168 to detect defective cigarettes and to produce signals which are used to segregate defective cigarettes from satisfactory cigarettes. If the sealing ring is not provided with passages 169, it can be mounted in such a way that its axis coincides with the axis 148A of the drive shaft 148. In other words, it is then sufficient to mount only the left-hand carrier 158 for rotation about an axis 158A which is inclined with respect to the axis 148A. In fact, even the illustrated carrier 187 can be mounted for rotation about the axis 148A if the inclination of the left-hand axis 158A is sufficient to enable the sealing elements 164 of the carrier 158 to rapidly engage the respective ends 171 of the wrappers of cigarettes 142 at the testing station and to allow for removal of tested cigarettes at the transfer station between the drum 140 and the conveyor 31 of FIG. 1 as well as for introduction of fresh cigarettes 142 at the transfer station between the conveyor 28 of FIG. 1 and the drum 140.

Figure 6:
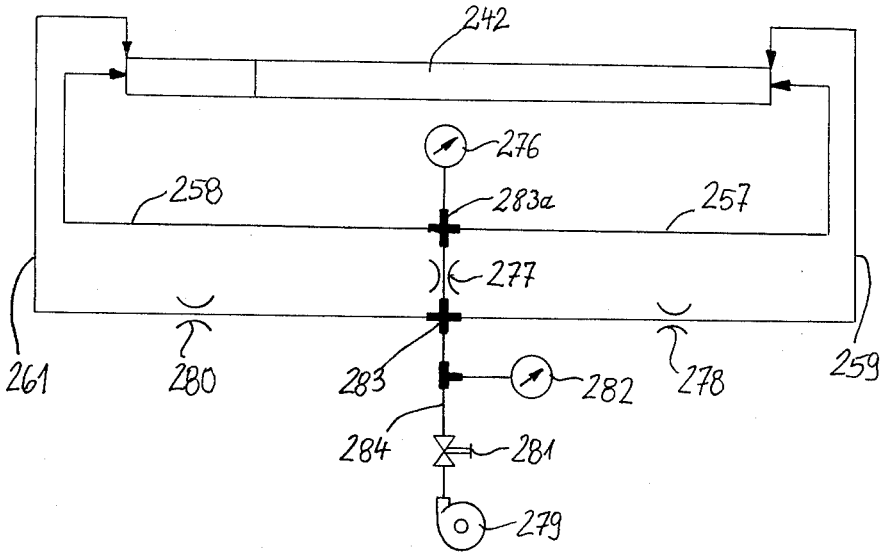
FIG. 6 is a diagram of a first system forming part of the improved testing apparatus and serving to control the admission of testing fluid streams, to monitor the fluid streams, and to subject the exterior of both ends of each wrapper at the testing station to the static pressure of a sealing fluid.

FIG. 6 shows a system which controls the admission of testing fluid into filter cigarettes 242 at the testing station of FIG. 2 as well as the establishment of static pressure of testing fluid in the chambers 77 of FIG. 2. The pipes 259 and 261 of FIG. 6 are connected with the pipes 78 of FIG. 2 to admit sealing fluid into the respective chambers 77. The supply conduits 257 and 258 of FIG. 6 respectively admit streams of testing fluid into the right-hand and left-hand nipples 68 of FIG. 2. The system of FIG. 6 further comprises a blower or another suitable source 279 of pressurized fluid (preferably air). The blower 279 has an outlet which is connected with a conduit 284 serving to supply pressurized fluid to a junction 283. The conduits 259 and 261 are connected with the junction 283, and the latter further serves to admit pressurized sealing fluid to the pipes 257 and 258. A flow restrictor 277 in a conduit connecting the junction 283 with a further junction **283*a* between the conduits 257 and 258 is adjustable to regulate the pressure of testing fluid which enters the respective sealing elements 64. This pressure is measured by a gauge 276 which constitutes or is connected with a suitable transducer serving to produce electric or other signals indicating the pressure of fluid in the conduits 257 and 258. Such signal can be utilized to effect segregation of defective cigarettes 242. Further adjustable flow restrictors 278 and 280 are respectively provided in the pipes 259 and 261. The conduit 284 is connected with a further gauge 282 and contains a pressure regulating valve 281 which is adjustable to select the pressure of fluid flowing toward the junction 283. Such pressure is indicated by the gauge 282.**

The operation of the system of FIG. 6 is as follows: The blower 279 supplies pressurized fluid into the conduit 284 which, in turn, supplies such fluid to the junction 283 from which the fluid can flow into the pipes 259, 261 as well as to the junction **283*a*. The junction 283*a* admits streams of testing fluid into the conduits 257 and 258 which admit such fluid into the respective nipples 68 shown in FIG. 2. The regulating valve 281 in the conduit 284 can be manipulated to select the pressure of fluid flowing toward the junction 283, and such pressure is indicated by the gauge 282. The throttling action of flow restrictors 278 and 280 is selected in such a way that the pressure of sealing fluid in the chambers 77 of FIG. 2 equals or closely approximates the pressure of testing fluid in the supply conduits 257 and 258. If the wrapper of the cigarette 242 shown in FIG. 6 has a hole or an open seam, the pressure of fluid in the conduits 257, 258 decreases, and such drop of fluid pressure is detected by the transducer 276 which effects a segregation of the respective cigarette 242 from satisfactory cigarettes. As stated above, the element 276 of FIG. 6 can serve exclusively as a gauge to indicate the pressure of fluid in the conduits 257, 258** and/or as a transducer which produces electrical, pneumatic or other signals serving for segregation of defective rod-shaped articles.

Figure 7:
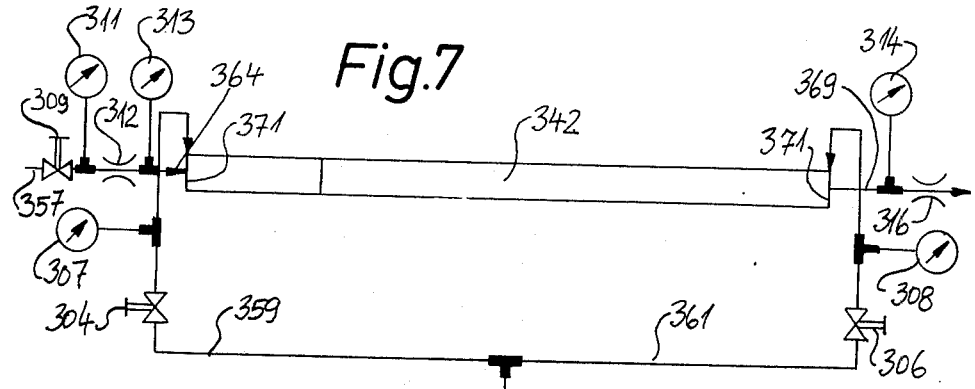
FIG. 7 is a diagram of a second system which constitutes a first modification of the system shown in FIG. 6.

FIG. 7 illustrates a system which can be used in the testing apparatus of FIG. 5 to admit a stream of testing fluid into one end of each filter cigarette 342 at the testing station. The supply conduit which admits testing fluid to the left-hand nipple 168 of FIG. 5 is shown at 357. This conduit admits testing fluid into a sealing element 364 which engages the left-hand end 371 of the wrapper of the cigarette 342. The right-hand end 371 of the wrapper of cigarette 342 is assumed to discharge testing fluid into a passage 369 corresponding to the passage 169 shown in the upper part of FIG. 5.

All such parts of the system shown in FIG. 7 which are identical with or clearly analogous to the corresponding parts of the system of FIG. 6 are denoted by similar reference characters plus 100. The pipes 359 and 361 receive pressurized sealing fluid from a source 303 and respectively contain adjustable regulating valves 304, 306 and gauges 307, 308. The pipes 359 and 361 respectively admit sealing fluid into the left-hand and right-hand pipes 178 shown in FIG. 5. The conduit 357 for admission of testing fluid contains an adjustable regulating valve 309 and a gauge 311 followed by a flow restrictor 312 which is located upstream of the left-hand nipple 168 of FIG. 5. The pressure of testing fluid between the flow restrictor 312 and the sealing element 364 of FIG. 7 is indicated by a gauge 313. The passage 369 for evacuation of testing fluid from the right-hand end 371 of the wrapper of the filter cigarette 342 of FIG. 7 contains a flow restrictor 316 and a gauge 314.

The operation of the system of FIG. 7 is as follows:

The sealing elements 364 which engage the filter cigarettes 342 approaching the testing station are caused to engage the respective ends 371 and to push the other (right-hand) ends 371 against a sealing surface corresponding to the sealing surface 186 shown in FIG. 5. The ends 371 enter the respective chambers so that their external surfaces are subjected to the pressure of fluid which is supplied into the respective chambers by the pipes 359 and 361. The sealing fluid prevents communication of testing fluid (supply conduit 357) with the surrounding atmosphere as well as communication of the passages 369 with the atmosphere. The pressure of fluid downstream of the flow restrictor 312 is substantially higher than the pressure of fluid upstream of the flow restrictor 316 because the filler of the filter cigarette 342 offers a certain resistance to the flow of testing fluid from the sealing element 364 toward the respective passage 369. The valves 304 and 306 are adjusted so that the pressure of fluid in the left-hand chamber equals or approximates the pressure of fluid in the sealing element 364, and that the pressure of fluid in the right-hand chamber equals or approximates the pressure of fluid in the corresponding passage 369. Thus, the pressure indicated by the gauge 307 should equal or approximate the pressure indicated by the gauge 313, and the pressure indicated by the gauge 308 should equal or approximate the pressure indicated by the gauge 314 of FIG. 7. The pressure of testing fluid in the conduit 357 is adjusted by the valve 309. The gauge 314 may constitute a transducer which produces signals when the pressure of fluid in the passage 369 deviates from a predetermined pressure range which is indicative of satisfactory cigarettes 342. Such signals are utilized to segregate defective cigarettes from satisfactory cigarettes. For example, the gauge or transducer 314 will produce a signal when the wrapper of a filter cigarette 342 has a relatively large hole or when the seam of the wrapper is open, either in part or in its entirety.

Figure 8:
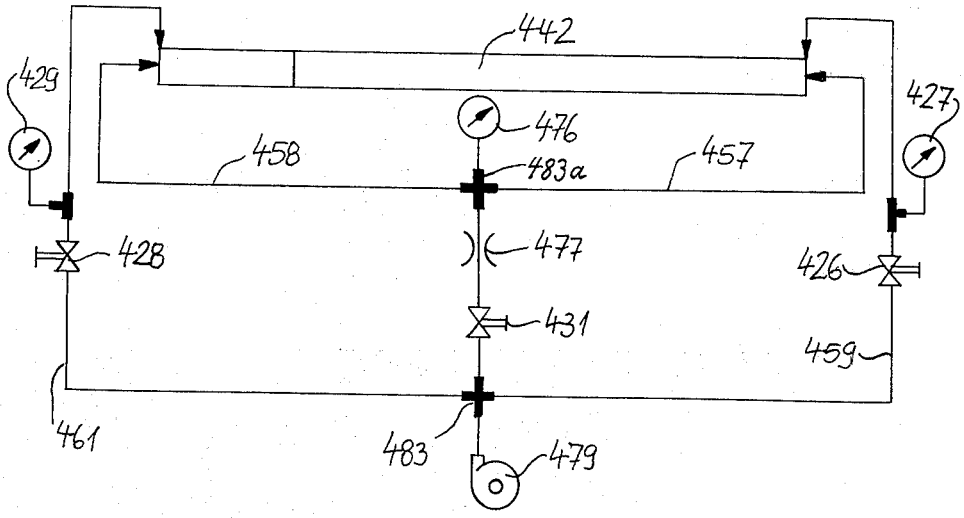
FIG. 8 is a diagram of a third system.

The system of FIG. 8 is similar to the system of FIG. 6, and all such parts which are identical with or clearly analogous to the corresponding parts of the system of FIG. 6 are denoted by similar reference characters plus 200. The main difference between the two systems is that the flow restrictors 278, 280 in the pipes 259, 261 of FIG. 6 are replaced by adjustable regulating valves 426, 428 followed by gauges 427, 429. The gauge 476 can constitute a transducer which produces signals when the fluid pressure in the supply conduits 457, 458 deviates from a predetermined pressure range. The flow restrictor 477 between the junctions 483 and 483a is located downstream of an adjustable regulating valve 431. The conduits 457, 458 admit testing fluid into the respective ends of a filter cigarette 442 at the testing station, and the pipes 461, 459 respectively admit sealing fluid into the left-hand and right-hand chambers of the testing apparatus using the system of FIG. 8.

The operation of the system shown in FIG. 8 is as follows:

The source 479 supplies pressurized fluid (preferably air) to the junction 483 which admits fluid into the pipes 459 and 461. The junction 483 further admits pressurized fluid into the conduit which connects it with the junction **483*a* and contains the flow restrictor 477 and the adjustable regulating valve 431. The junction 483*a* admits testing fluid into the conduits 457 and 458. The valves 426 and 428 are manipulated to adjust the pressure of sealing fluid in the respective chambers so that such pressure equals or closely approximates the normal fluid pressure in the conduits 457 and 458. The pressure in the conduits 457, 458 is indicated by the gauge 476, and the pressure in the pipes 459, 461 is respectively indicated by the gauges 427 and 429. The valve 431 is adjusted to select the desired pressure of testing fluid in the conduits 457 and 458.**

Figure 9:
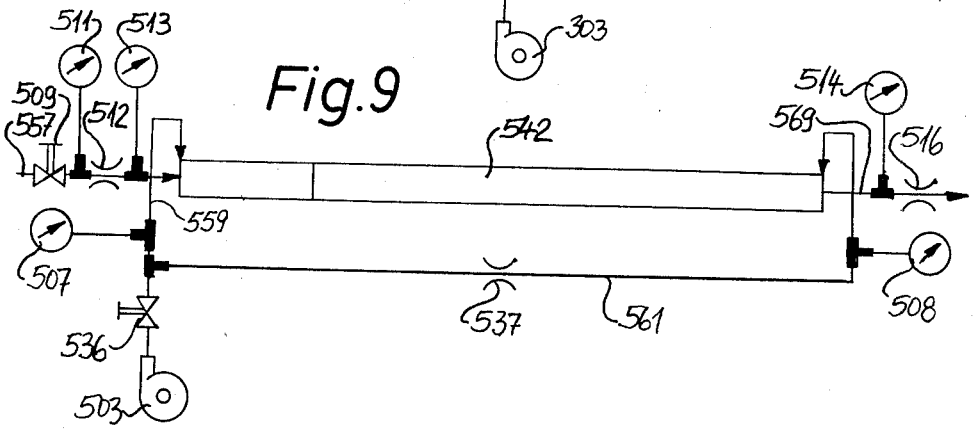
FIG. 9 is a diagram of a fourth system.

The system of FIG. 9 constitutes a modification of the system which is shown in FIG. 7. All such parts of this system which are identical with or clearly analogous to the corresponding parts of the system of FIG. 7 are denoted by similar reference characters plus 200. The valve 306 of FIG. 7 is replaced by a flow restrictor 537 in the pipe 561. The pipes 559 and 561 receive pressurized sealing fluid from a source 503, and the pressure of such fluid can be regulated by an adjustable valve 536. The gauge 507 indicates the pressure of fluid in the pipe 559, and the gauge 508 indicates the fluid pressure in the pipe 561 downstream of the flow restrictor 537. The flow restrictor 537 ensures that the pressure of testing fluid in the right-hand chamber is less than the pressure of the sealing fluid in the left-hand chamber. This is necessary because the pressure of testing fluid issuing from a filter cigarette 542 is less than the pressure of testing fluid which is admitted by way of the supply conduit 557.

The operation of the system of FIG. 9 is as follows:

The supply conduit 557 admits testing fluid into the left-hand end of a filter cigarette 542 at the testing station, whereby such fluid passes through the adjustable regulating valve 509 and flow restrictor 512. The testing fluid which issues from the filter cigarette 542 enters the passage 569 which contains the flow restrictor 516. The gauge or transducer 514 upstream of the flow restrictor 516 produces signals when the pressure of testing fluid in the passage 569 deviates from a predetermined range of satisfactory pressures. The pressure which is indicated by the gauge 508 should equal or approximate the pressure indicated by the gauge 514 when the system of FIG. 9 is utilized for the testing of a satisfactory filter cigarette 542. Analogously, the gauge 507 should indicate a pressure which corresponds to the pressure indicated by the gauge 513. The flow restrictor 537 is preferably adjustable.

Figure 10:
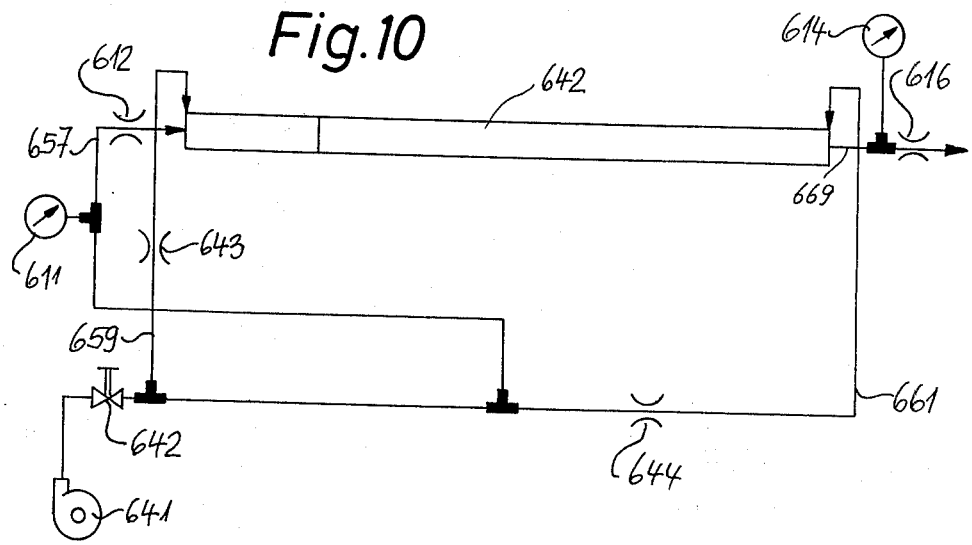
FIG. 10 is a diagram of a fifth system.

FIG. 10 illustrates a system which consitutes a further modification of the system shown in FIGS. 7 and 9. All such parts of the system of FIG. 10 which are identical with or clearly analogous to the corresponding parts of the system shown in FIG. 7 are denoted by similar reference characters plus 300. The main difference between the systems of FIG. 7 and FIG. 10 is that the source 641 of FIG. 10 supplies sealing fluid to the pipes 659, 661 as well as a stream of testing fluid to the supply conduit 657 which contains a flow restrictor 612 located downstream of a gauge 611. The pipe 659 contains a flow restrictor 643, and the pipe 661 contains a flow restrictor 644. The pipe which connects the outlet of the source 641 with the pipes 659 and 661 contains an adjustable regulating valve 642. The supply conduit 657 branches from the pipes 659, 661 downstream of the adjustable regulating valve 642. The passage 669 contains a gauge 614 followed by a flow restrictor 616. The gauge 614 can act as a transducer which produces signals when the fluid pressure in the passage 669 deviates from a range of satisfactory pressures whereby the signal from the transducer causes a suitable ejector to segregate defective filter cigarettes 642 from satisfactory filter cigarettes. The throttling action of the flow restrictor 643 is identical or similar to that of the flow restrictor 612. The throttling action of the flow restrictor 644 is preferably such that the pressure of fluid in the pipe 661 corresponds to the pressure indicated by the gauge or transducer 614.

The operation of the system of FIG. 10 is as follows:

The source 641 supplies pressurized fluid into the pipes 659, 661 and conduit 657. The pressure of such fluid can be selected by manipulating the regulating valve 642. The gauge 611 is optional; its main function is to indicate eventual malfunctions of the system, such as clogging of the pipe 659 or 661 and/or clogging of the supply conduit 657.

Figure 11:
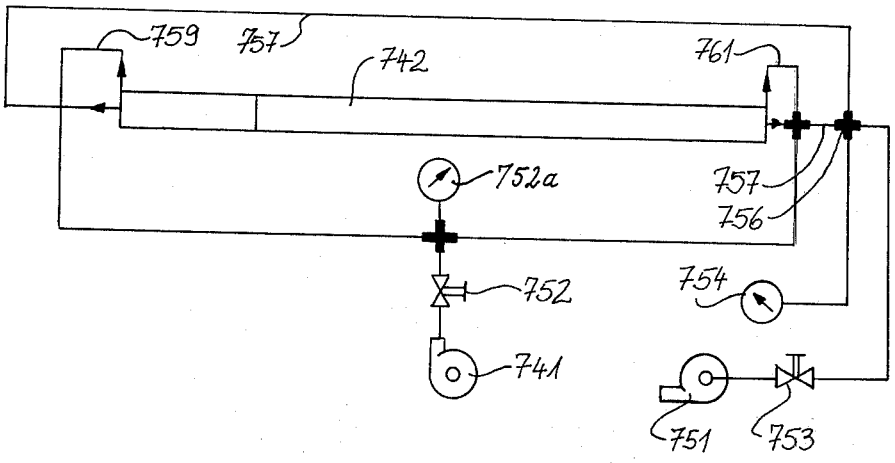
FIG. 11 is a diagram of a sixth system.

The system of FIG. 11 constitutes a further modification of the system shown in FIG. 6. This system differs from the heretofore described systems in that the filter cigarettes 742 are tested by streams of testing fluid which is maintained at a pressure less than atmospheric pressure. It comprises a suction generating device 751 which is connected with a conduit 757 serving to draw air from both ends of the filter cigarette 742 at the testing station. The conduit 757 contains an adjustable regulating valve 753. A junction 756 in the conduit 757 is connected with a gauge 754 which constitutes a transducer and furnishes signals when the pressure in the conduit 757 deviates from a range of satisfactory fluid pressures. The pipes 759 and 761 which serve to draw air from the two chambers of the testing apparatus are connected with a suction generating device 741 by way of an adjustable regulating valve 752. The pressure of fluid in the pipes 751, 761 is indicated by a gauge 752a. When the wrapper of a filter cigarette 742 at the testing station is satisfactory, the pressure which is indicated by the gauge 752*a* should correspond to the pressure which is indicated by the gauge or transducer 754. Such equalization of testing and sealing fluid pressures can be achieved by appropriate manipulation of the valves 752 and 753.

The operation of the system of FIG. 11 is analogous to the operation of previously described systems. The only difference is that the pressure of testing fluid is maintained below atmospheric pressure and, therefore, the pressure of sealing fluid is also below atmospheric pressure. It is clear that the two discrete suction generating devices 741, 751 of FIG. 11 can be replaced by a single suction generating device which draws fluid from the pipes 759, 761 and from both conduits 757.

An important advantage of the improved testing apparatus and method is that the likelihood of segregation of satisfactory rod-shaped articles together with defective articles is reduced to a minimum, as well as that defective rod-shaped articles are likely to be detected and segregated with the same degree of certainty as in conventional testing apparatus. Furthermore, the sensitivity of the testing apparatus can be selected at will so as to ensure that the apparatus will not segregate articles whose wrappers exhibit defects close to the ends, i.e., that the articles which are otherwise satisfactory will not be segregated in spite of the fact that they might exhibit holes, tears and/or other defects close to or at the very ends. Another important advantage of the apparatus is that its sensitivity is not affected by eventual depositions of foreign matter on the end faces of fillers in the articles to be tested and/or on the outer sides of membranes shown in FIGS. 2 and 5.

A further advantage of the apparatus is that, regardless of whether the apparatus comprises a single chamber or two chambers for sealing fluid, the desirable optimum pressure of sealing fluid in such chamber or chambers can be maintained with minimal expenditures in material and energy. This will be readily appreciated since, once a proper sealing pressure is built up, it remains practically unchanged while the apparatus continues to test cigarettes at the rate at which the cigarettes are being produced in the filter cigarette making machine of FIG. 1 or in another machine for the production of rod-shaped articles which contain tobacco and/or filter material.

As shown in FIGS. 3 and 4 the length of a chamber can exceed several times the distance between two neighboring flutes of the conveying means which transports cigarettes past the testing station. However, the overall length of each chamber need not exceed a small fraction of the distance between the transfer station where the drum of the testing apparatus receives rod-shaped articles and the transfer station where the drum of the testing apparatus transfers tested articles to the next-following conveyor, such as the conveyor 31 of FIG. 1. With reference to FIG. 1, where the distance between the two testing stations is about 180°, the length of a chamber for sealing fluid can be a small fraction of 180°, for example, 30°, as considered in the circumferential direction of the drum 40 in the testing apparatus 29.

It is further within the scope of the invention to equip the improved testing apparatus with one or more chambers for sealing fluid whose casings are adjustable with reference to the drum of the testing apparatus. For example the casings 79 of FIG. 2 can be mounted for movement radially of the drum 40 so as to increase or reduce the width of the gaps 82 and 84.

The carriers (such as the carriers 58 of FIG. 2) which rotate about axes which are inclined with respect to the axis of the drum of the conveying means for rod-shaped articles exhibit the advantage that the sealing elements (such as 64 of FIG. 2) need not be moved axially by followers and cams of the type used in presently known testing apparatus for cigarettes or the like.

Without further analysis, the foregoing will so fully reveal the gist of the present invention that others can, by applying current knowledge, readily adapt it for various applications without omitting features which fairly constitute essential characteristics of the generic and specific aspects of our contribution to the art and, therefore, such adaptations should and are intended to be comprehended within the meaning and range of equivalence of the claims.

What is claimed as new and desired to be protected by Letters Patent is set forth in the appended:

1. Apparatus for testing cigarettes or analogous rod-shaped articles wherein an open-ended tubular wrapper surrounds a gas-permeable filler, comprising means for conveying the articles sideways past a testing station, said conveying means comprising a rotary member; means for passing streams of a gaseous testing fluid through the fillers of articles at said testing station whereby at least one characteristic of said streams changes during passage through the fillers of articles having defective fillers and/or wrappers, including (at least one ring-shaped carrier) apertured sealing elements adjacent to one end of each wrapper on said rotary member, said sealing elements being rotatable with said rotary member (about an axis which is inclined with respect to the axis of said rotary member so that successive increments of said carrier), and means for respectively (approach and move) moving said sealing elements toward and away from the neighboring wrapper ends during movement of said (increments) sealing elements toward and away from said testing station, (and apertured) said sealing elements (mounted in said carrier) being in register with the respective wrappers on said rotary member and each thereof being arranged to engage the filler at said one end of the registering wrapper during travel past said testing station; means for monitoring said streams to detect the changes in said one characteristic thereof; and sealing means for subjecting the exterior of at least said one end of each wrapper at said testing station to the static pressure of a gaseous sealing fluid to thereby reduce the extent of or to prevent communication between the respective fluid stream and the atmosphere.

2. Apparatus as defined in claim 1, wherein each of said sealing elements has a deformable filler-engaging membrane.

3. Apparatus for testing cigarettes or analogous rod-shaped articles wherein the open-ended tubular wrapper surrounds a gas-permeable filler, comprising means for conveying the articles sideways past a testing station; means for passing streams of a gaseous testing fluid through the fillers of articles at said testing station whereby at least one characteristic of said streams changes during passage through the fillers of articles having defective fillers and/or wrappers; means for monitoring said streams to detect the changes in said one characteristic thereof; and sealing means for subjecting the exterior of at least one end of each wrapper at said testing station to substantially constant (the) static pressure of a gaseous sealing fluid to thereby reduce the extent of or to prevent communication between the respective fluid stream and the atmosphere, said static pressure being applied to a small fraction of the exterior of the wrapper at the respective end thereof.

4. Apparatus as defined in claim 3, wherein said means for passing said streams through the fillers comprises apertured sealing elements each in register with the one end of the wrapper of an article on said conveying means, and means for maintaining said sealing elements in engagement with the fillers at the respective ends of the wrappers during travel of articles past said testing station.

5. Apparatus as defined in claim 3, wherein said sealing means comprises a stationary chamber located at said testing station and containing said sealing fluid, said one end of each wrapper which is conveyed past said testing station being located in said chamber.

6. Apparatus as defined in claim 5, wherein said chamber has wall means closely adjacent to and defining with said conveying means at least one narrow gap.

7. Apparatus as defined in claim 3, wherein said sealing means comprises two chambers both located at said testing station and each containing said sealing fluid, each of said chambers receiving a different end of a wrapper while the respective article is being conveyed past said testing station.

8. Apparatus as defined in claim 3, wherein said sealing means comprises a plenum chamber including a casing which surrounds the conveying means at said testing station with minimal clearance and means for supplying sealing fluid to said casing, said means for passing said streams through the fillers comprising apertured sealing elements each in register with the one end of the wrapper of an article on said conveying means and means for maintaining said sealing elements in engagement with the fillers at the respective ends of the wrappers during travel of articles past said testing station, at least a portion of a sealing element which moves past said testing station being located in said casing.

9. Apparatus as defined in claim 3, wherein said sealing means comprises a chamber which is elongated, as considered in the direction of movement of said conveying means, so as to receive the ends of several wrappers in the region of said testing station.

10. A method of testing cigarettes or analogous rod-shaped articles wherein an open-ended tubular wrapper surrounds a gas-permeable filler, comprising the steps of conveying the articles sideways past a testing station; passing streams of a gaseous testing fluid through the fillers of articles at said testing station whereby at least one characteristic of said streams changes during passage through the fillers of articles having defective fillers and/or wrappers; monitoring said streams to detect the changes in said one characteristic thereof; and subjecting the exterior of at least one end of each wrapper at said testing station to substantially constant (the) static pressure of a gaseous sealing fluid to thereby reduce the extent of or to prevent communication between the respective fluid stream and the atmosphere, said static pressure being applied to a small fraction of the exterior of the wrapper at the respective end thereof.

11. A method as defined in claim 10, wherein each of said streams is introduced into the respective filler at said one end of the corresponding wrapper.

12. A method as defined in claim 10, wherein at least one of said fluids is air.

13. A method as defined in claim 10, further comprising the step of at least partially sealing said streams from said sealing fluid at said testing station.

14. A method as defined in claim 10, further comprising the step of maintaining said sealing fluid at a pressure which approximates or equals the pressure of testing fluid at said one end of a wrapper at said testing station.

15. A method as defined in claim 14, wherein said pressure of said sealing fluid exceeds atmospheric pressure.

16. A method as defined in claim 14, wherein said pressure of said sealing fluid is less than atmospheric pressure.

* * * * *

UNITED STATES PATENT OFFICE

CERTIFICATE OF CORRECTION

Patent No. 3,962,906 Dated June 15, 1976

Inventor(s) Uwe HEITMANN and Heinz-Christen LORENZEN

It is certified that error appears in the above-identified patent and that said Letters Patent are hereby corrected as shown below:

Col. 1, line 28, "warrents" should read --warrants--;
line 49, "suitabel elements" should read --suitable sealing elements--.

Col. 2, line 45, "prevention" should read --preventing--.

Col. 3, line 4, "subject" should read --subjecting.

Col. 4, line 46, "conveyor" should read --conveyors--;
line 52, "clearance" should read --clearances--;
line 66, "10" should read --19--.

Col. 16, line 28, insert comma after "4".

Claim 1, lines 10-11 delete "(at least one ring-shaped carrier)".
lines 14-16 delete "(about an axis which is inclined with respect to the axis of said rotary member so that successive increments of said carrier)";
line 17, delete "(approach and move)";
lines 19-20, delete "(increments)";
line 21, delete "(and apertured)";
line 22, delete "(mounted in said carrier)".

Claim 3, line 2, "the" should read --an--;
line 13, delete "(the)".

Claim 10, line 13, delete "(the)'.

Signed and Sealed this

Twenty-eighth Day of September 1976

[SEAL]

*Attest:*

RUTH C. MASON
*Attesting Officer*

C. MARSHALL DANN
*Commissioner of Patents and Trademarks*